US006250177B1

(12) United States Patent
Sasahara

(10) Patent No.: US 6,250,177 B1
(45) Date of Patent: Jun. 26, 2001

(54) CAM APPARATUS

(75) Inventor: Tadashi Sasahara, Fujisawa (JP)

(73) Assignee: Oiles Corporation, Tokyo (JP)

( * ) Notice: Subject to any disclaimer, the term of this patent is extended or adjusted under 35 U.S.C. 154(b) by 0 days.

(21) Appl. No.: 09/382,818

(22) Filed: Aug. 25, 1999

(30) Foreign Application Priority Data

Aug. 26, 1998 (JP) ..... 10-240451

(51) Int. Cl.[7] ..... B21D 28/34; B21D 37/08

(52) U.S. Cl. ..... 74/567; 74/110; 72/381; 83/588

(58) Field of Search ..... 74/110, 567; 72/304, 72/315, 381, 452.9; 83/588, 635

(56) References Cited

U.S. PATENT DOCUMENTS

| | | | | |
|---|---|---|---|---|
| 5,101,705 | | 4/1992 | Matsuoka | 83/588 |
| 5,471,901 | * | 12/1995 | Nishiya et al. | 83/588 X |
| 5,487,296 | | 1/1996 | Gerhart et al. | 72/381 |
| 5,711,180 | | 1/1998 | Sasahara et al. | 72/381 |
| 5,881,599 | * | 3/1999 | Sasahara et al. | 74/110 |
| 5,904,064 | * | 5/1999 | Higuchi | 72/452.9 |
| 5,931,074 | * | 8/1999 | Matsuoka | 83/588 |

FOREIGN PATENT DOCUMENTS

| | | |
|---|---|---|
| 0 484 588 A 1 | 5/1992 | (EP) . |
| 60-203327 | 10/1985 | (JP) . |
| 4-138825 | 5/1992 | (JP) . |

OTHER PUBLICATIONS

Patent Abstracts of Japan, vol. 10, No. 55 (M–458), Mar. 5, 1986.

* cited by examiner

*Primary Examiner*—Richard M. Lorence
(74) *Attorney, Agent, or Firm*—Nixon & Vanderhye

(57) ABSTRACT

A cam apparatus includes: a cam driver having a sliding surface with a V-shaped cross section; a cam slide having a sliding surface of a shape complementary to the sliding surface of the cam driver in such a manner as to be slidably brought into contact with the sliding surface of the cam driver; and a cam-slide supporting base for movably supporting the cam slide so that the cam slide can move while being guided by the sliding surface of the cam driver as the sliding surface of the cam slide and the sliding surface of the cam driver are brought into contact with each other. The cam slide is disposed with a gap with respect to the cam-slide supporting base.

8 Claims, 9 Drawing Sheets

CAM APPARATUS

BACKGROUND OF THE INVENTION

1. Field of the Invention

The present invention relates to a cam apparatus for performing processing such as punching, bending, and the like with respect to a workpiece such as a thin plate by means of a tool fitted to a cam slide by causing the cam slide to slide by a cam driver.

2. Description of the Related Art

In a cam apparatus of a suspended or aerial cam type including, for example, a cam driver having a sliding surface with a V-shaped cross section and attached to a lower die base by means of a knock pin, screws, and the like, a cam slide having a sliding surface of a shape complementary to that sliding surface, and a cam-slide supporting base which movably supports the cam slide and is attached to an upper die base by means of the knock pin, screws, and the like, there is an advantage in that it is possible to mount the cam slide on the cam driver in a state in which the cam slide is removed from the cam-slide supporting base and the upper die is not disposed, as well as to effect the positioning, i.e., cutting edge adjustment, of a tool such as a piercing punch attached to the cam slide with respect to, for example, a button die provided in the lower die.

After the cutting edge adjustment, if the cam-slide supporting base is attached to the upper die base by means of the knock pin, screws, and the like, and if the cam slide is attached to the cam-slide supporting base, there are cases where, due to an error in attaching the cam-slide supporting base to the upper die base, an error in attaching the cam slide to the cam-slide supporting base, an error in the disposition of the upper die and the lower die, and the like, the once-set positions of the piercing punch and the button die become offset by more than an allowance, e.g., by more than 0.04 mm to 0.05 mm on one side in the case of the piercing of a thin plate, and the mutual sliding surfaces of the cam driver and the cam slide fail to come into desired surface contact with each other, causing one-sided contact. This can result in the occurrence of burrs in actual processing and the possible incidence of breakage of the piercing punch as it rides over the button die.

SUMMARY OF THE INVENTION

The present invention has been devised in view of the above-described circumstances, and its object is to provide a cam apparatus which is capable of making use of the advantage in the aforementioned cutting edge adjustment in the cam apparatus comprised of a cam driver having a sliding surface with a V-shaped cross section and a cam slide having a sliding surface with a shape complementary to that sliding surface, and which, even if the aforementioned attaching errors and disposition error occur, is capable of ensuring desired surface contact of the mutual sliding surfaces of the cam driver and the cam slide and of overcoming the drawbacks of one-sided contact and the like, and capable of eliminating the occurrence of burrs in actual processing and the possible incidence of breakage of a piercing punch as it rides over a button die.

To this end, in accordance with a first aspect of the present invention, there is provided a cam apparatus comprising: a cam driver having a sliding surface with a V-shaped cross section and adapted to be fixedly supported by a cam-driver supporting base; a cam slide having a sliding surface of a shape complementary to the sliding surface of the cam driver in such a manner as to be slidably brought into contact with the sliding surface of the cam driver; and a cam-slide supporting base for movably supporting the cam slide so that the cam slide can move while being guided by the sliding surface of the cam driver as the sliding surface of the cam slide and the sliding surface of the cam driver are brought into contact with each other, wherein at least one of the cam driver and the cam slide is supported by the supporting base of the at least one of them in such a manner as to be movable in a transverse direction perpendicular to a moving direction of the cam slide.

In the cam apparatus according to the above-described first aspect of the invention, since at least one of the cam driver and the cam slide is supported by the supporting base of the at least one of them in such a manner as to be movable in the transverse direction perpendicular to the moving direction of the cam slide, in the contact of the sliding surface of the cam slide and the sliding surface of the cam driver, at least one of the cam driver and the cam slide can be automatically moved in the transverse direction perpendicular to the moving direction of the cam slide. Thus, it is possible to automatically correct the positional offset of, for example, the piercing punch and the button die due to an error in attaching the cam-slide supporting base to the upper die base, an error in attaching the cam slide to the cam-slide supporting base, an error in the disposition of the upper die and the lower die, and the like. Consequently, it is possible to make use of the advantage in the aforementioned cutting edge adjustment in the cam apparatus comprised of the cam driver having the sliding surface with a V-shaped cross section and the cam slide having the sliding surface with a shape complementary to that sliding surface, and even if the aforementioned attaching errors and disposition error occur, it is possible to ensure desired surface contact of the mutual sliding surfaces of the cam driver and the cam slide, overcome the drawbacks of one-sided contact and the like, and eliminate the occurrence of burrs in actual processing and the possible incidence of breakage of the piercing punch as it rides over the button die.

In accordance with a second aspect of the present invention, in the cam apparatus according to the first aspect, the at least one of the cam driver and the cam slide is disposed with a gap with respect to the supporting base of the at least one of them in the transverse direction perpendicular to the moving direction of the cam slide.

To make at least one of the cam driver and the cam slide movable, a gap may be merely provided as in the cam apparatus in the second aspect, in which case the width of the gap (the width in the transverse direction perpendicular to the moving direction of the cam slide) may preferably be determined on the basis of the total of the aforementioned errors and an allowance of the offset.

In accordance with a third aspect of the present invention, in the cam apparatus according to the second aspect, a resilient means is disposed in the gap, and this resilient means in a fourth aspect of the invention is covered by a slide plate and is secured together with the slide plate to at least one of the cam driver and the cam slide or to the supporting base for supporting the at least one of them. The resilient means may be a leaf spring formed of spring steel, a rubber plate formed of urethane rubber or the like, or a combination of these members in a laminated form.

By disposing the resilient means in the gap, as compared with the cam apparatus which has the gap alone, the possibility of looseness of the cam slide during the operation can be eliminated, thereby making it possible to ensure reliable sliding motion of the cam slide.

In accordance with a fifth aspect of the present invention, in the cam apparatus according to any one of the first to fourth aspects, the cam-slide supporting base includes a base body having a recessed portion and having a pair of side walls defining the recessed portion, and a pair of cam-slide coming-off preventing plates secured to the side walls of the base body, respectively, and the cam slide includes a cam slide body to which a tool is adapted to be attached and on which the sliding surface of the complementary shape is formed, a slide member disposed in the recessed portion of the base body, and a constricted connecting portion which connects the cam slide body and the slide member and is disposed between the cam-slide coming-off preventing plates. In accordance with a sixth aspect of the present invention, in the cam apparatus according to any one of the first to fourth aspects, the cam-slide supporting base includes a base body having a recessed portion and having a front wall and a rear wall which define the recessed portion, and a cam-slide coming-off preventing rod secured to the front wall and the rear wall of the base body, and the cam slide includes a cam slide body to which a tool is adapted to be attached and on which the sliding surface of the complementary shape is formed, and a slide member which is disposed in the recessed portion of the base body and through which the cam-slide coming-off preventing rod is passed.

In the present invention, the cam slide may be arranged to be prevented from coming off the cam-slide supporting base by means of the cam-slide coming-off preventing plates as in the cam apparatus according to the fifth aspect, or may be arranged to be prevented from coming off the cam-slide supporting base by means of the cam-slide coming-off preventing rod as in the cam apparatus according to the sixth aspect. As the cam-slide coming-off preventing rod, a cylinder is generally used, and a gap is provided around this cylinder, but a prism, such as a triangular prism or a quadrangular prism, or an elliptic cylinder may be used instead. Whichever one of the cylinder, the prism, and the elliptic cylinder is used, it suffices, in short, if the gap is arranged so that at least one of the cam driver and the cam slide becomes movable in the transverse direction perpendicular to the moving direction of the cam slide.

In accordance with a seventh aspect of the present invention, in the cam apparatus according to any one of the first to sixth aspects, the cam-slide supporting base is adapted to be attached to either one of a lower die base and an upper die base, and the cam-driver supporting base constitutes another one of the lower die base and the upper die base.

In accordance with an eighth aspect of the present invention, the cam apparatus according to any one of the first to seventh aspects further comprises: a returning means for returning the cam slide to its initial position when the sliding surface of the cam slide and the sliding surface of the cam driver are in noncontact with each other.

Hereafter, a description will be given of the present invention with reference to the embodiments shown in the drawings. It should be noted that the present invention is not limited to these embodiments.

DESCRIPTION OF THE PREFERRED EMBODIMENTS

Figure 1:
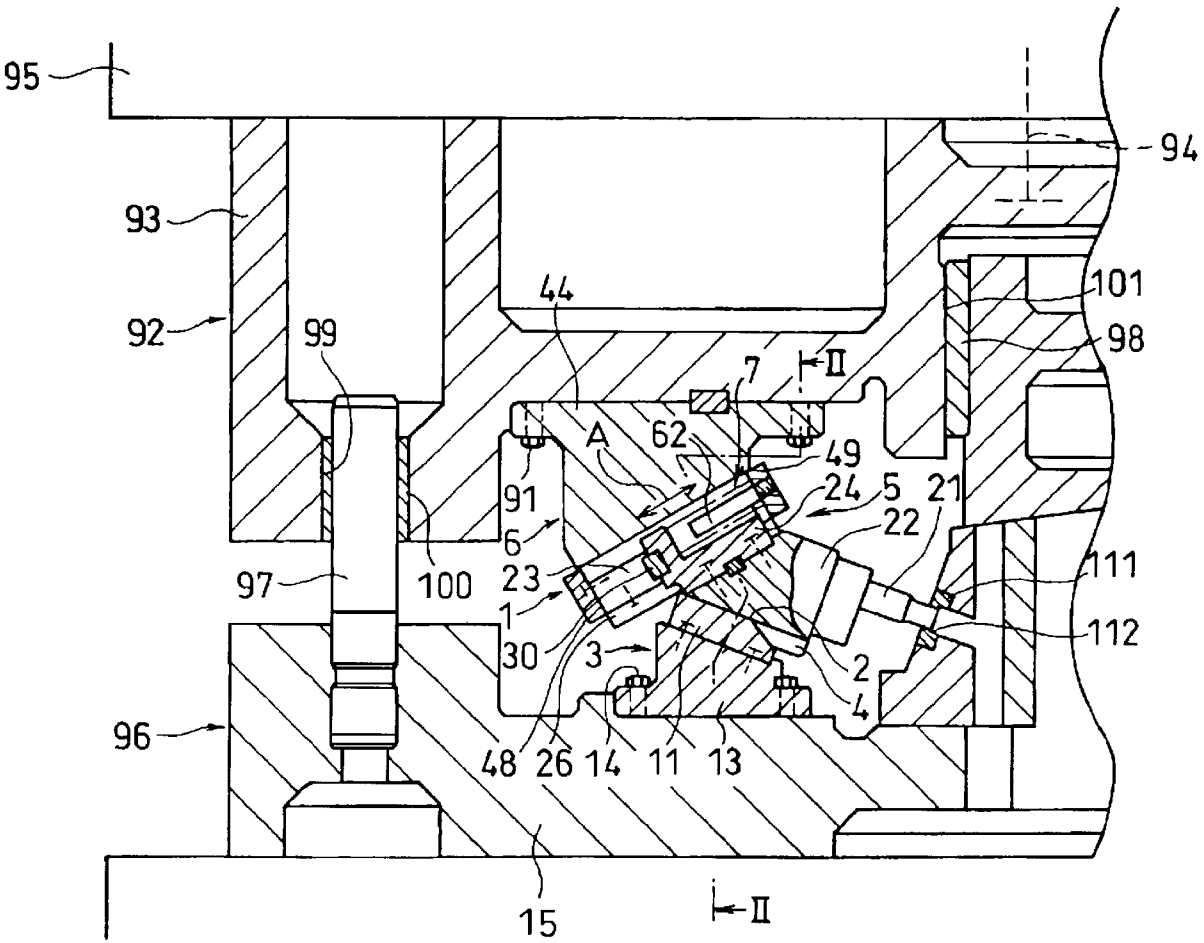
FIG. 1 is a side cross-sectional view of a preferred embodiment of the present invention.
Figure 2:
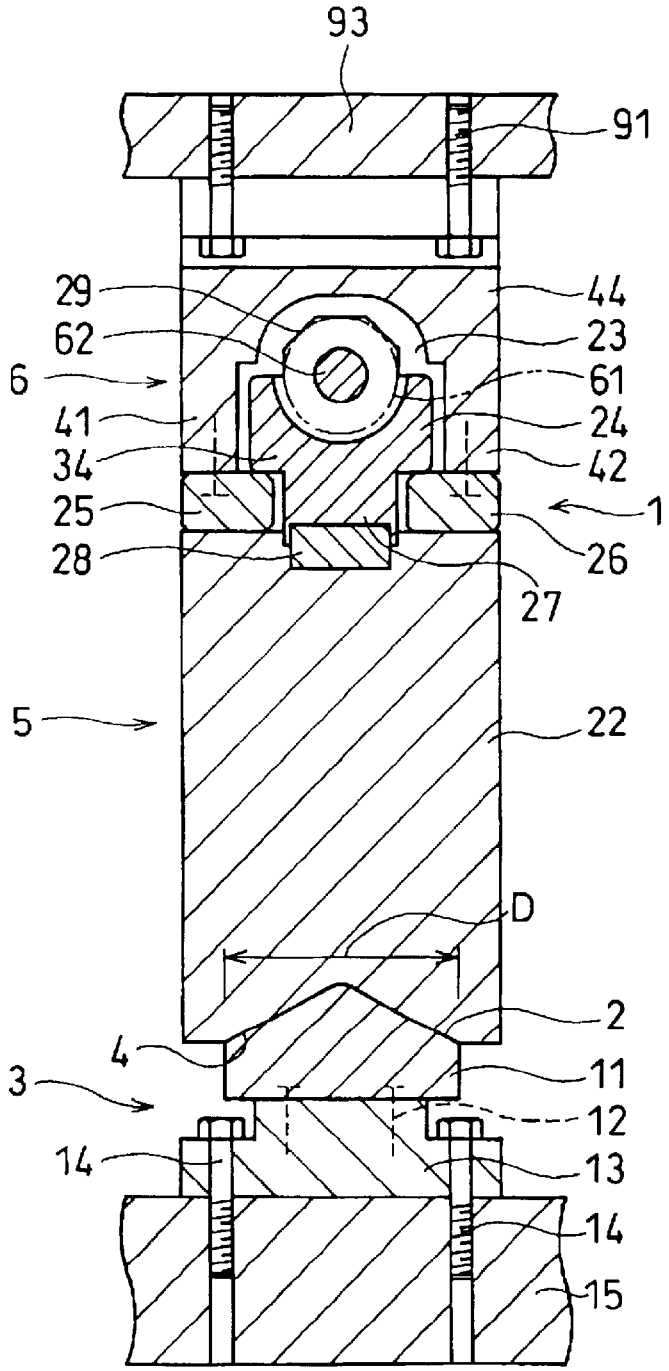
FIG. 2 is a cross-sectional view taken along line II—II shown in FIG. 1.
Figure 3:
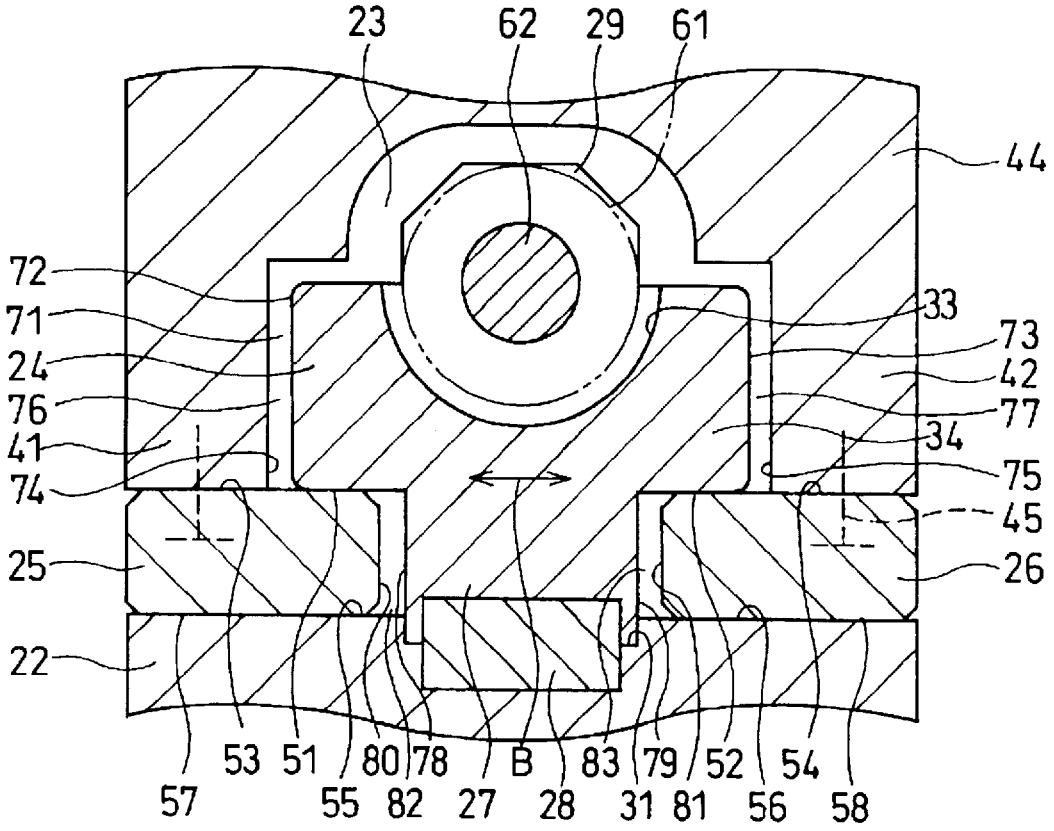
FIG. 3 is a partial enlarged view of the cross-sectional view shown in FIG. 2.
Figure 4:
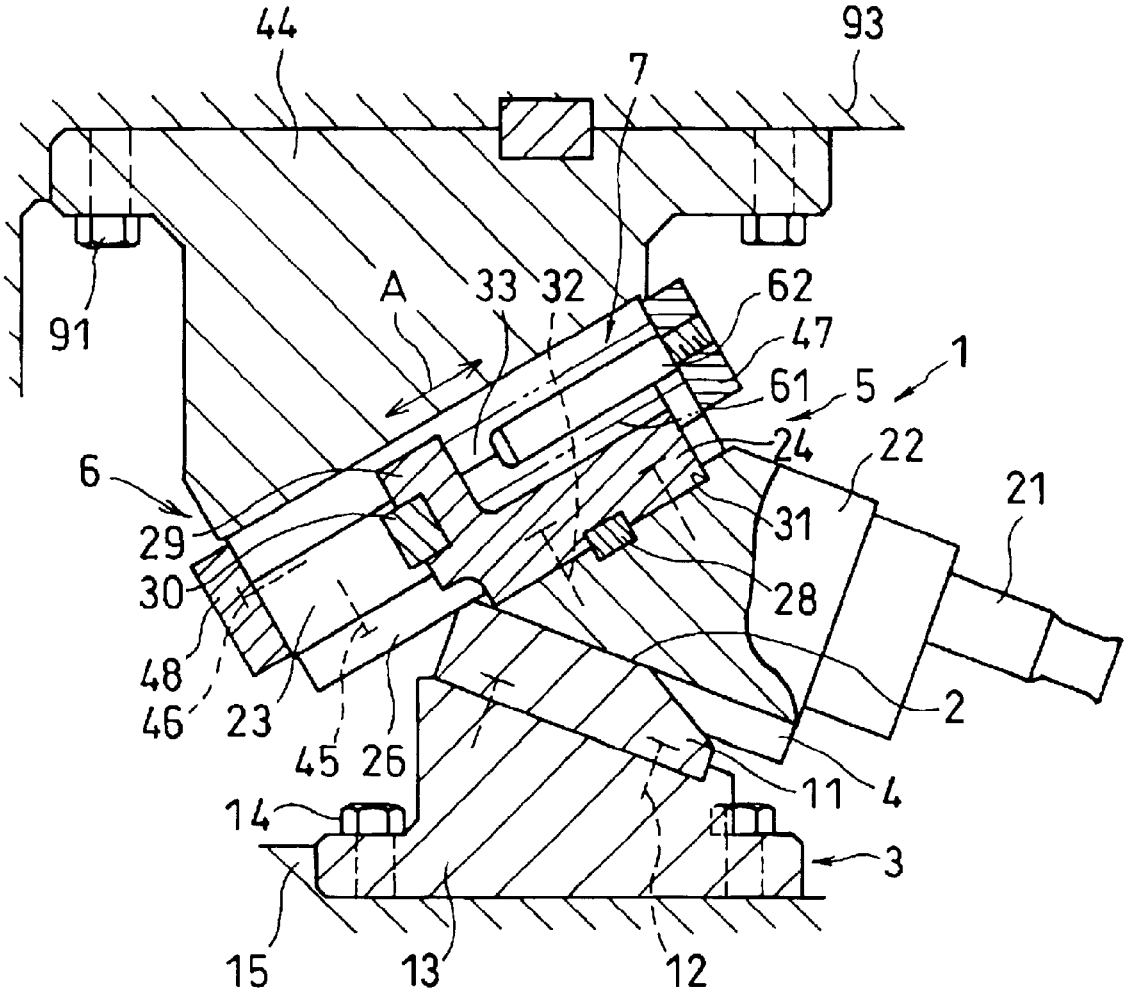
FIG. 4 is a partial enlarged cross-sectional view of the embodiment shown in FIG. 1.
Figure 5:
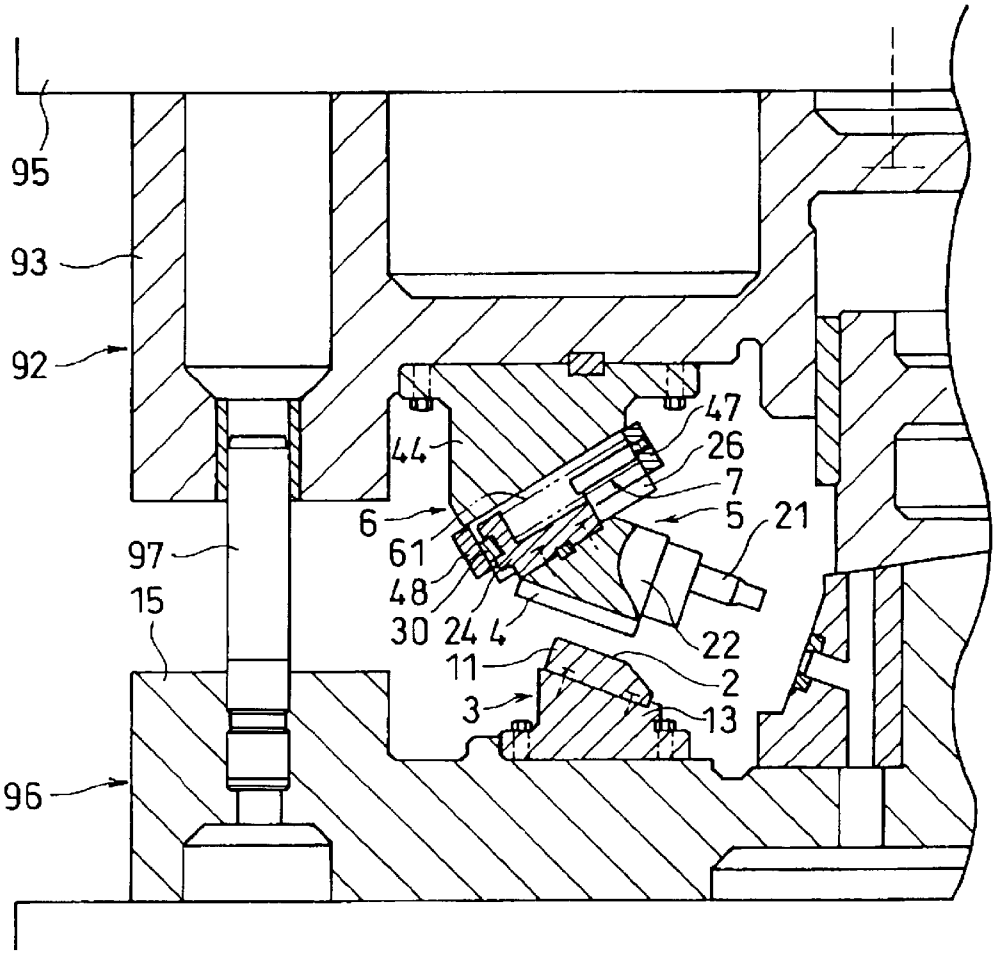
FIG. 5 is a diagram explaining the operation of the example shown in FIG. 1.

In FIGS. 1 to 3, a cam apparatus 1 of this embodiment is comprised of a cam driver 3 having a sliding surface 2 with a V-shaped cross section; a cam slide 5 having a sliding surface 4 with a V-shaped cross section which is shaped in a manner complementary to the sliding surface 2 in such a way as to slidably contact the sliding surface 2 of the cam driver 3; a cam-slide supporting base 6 for movably supporting the cam slide 5 in a direction A so that the cam slide 5 can move in the direction A while being guided by the sliding surface 2 of the cam driver 3 as the sliding surface 4 of the cam slide 5 and the sliding surface 2 of the cam driver 3 are brought into contact with each other; and a returning means 7 for returning the cam slide 5 to its initial position when the sliding surface 4 of the cam slide 5 and the sliding surface 2 of the cam driver 3 are not in contact with each other (see FIG. 5).

The cam driver 3 includes a cam plate 11 on an upper surface of which the sliding surface 2 with the V-shaped cross section is formed, and a cam base 13 on an upper surface of which the cam plate 11 is secured by means of screws 12 or the like. The cam base 13 is attached to a lower die base 15, which constitutes a cam-driver supporting base, by means of screws 14 or the like. The cam driver 3 is thus fixedly supported by the lower die base 15.

The cam slide 5 includes a cam slide body 22 to which a piercing punch 21 serving as a tool is adapted to be attached and on which the sliding surface 4 with the V-shaped cross section is formed; a slide member 24 disposed in a recessed portion 23 of the cam-slide supporting base 6; a constricted connecting portion 27 which is disposed between a pair of cam-slide coming-off preventing plates 25 and 26 of the cam-slide supporting base 6; a key member 28 for preventing the sliding of the constricted connecting portion 27 in the direction A with respect to the cam slide body 22; and an elastic member 30 such as rubber which is attached to a rear wall portion 29 of the slide member 24 so as to avoid the collision of the rear wall portion 29 against a rear wall 48 of the cam-slide supporting base 6.

The slide member 24 and the constricted connecting portion 27 are formed integrally, and a lower portion of the constricted connecting portion 27 is disposed in a cavity 31 of the cam slide body 22 and is secured to the cam slide body 22 by means of screws 32 or the like. The slide member 24 is comprised of a slide portion 34 in which a semicylindrical recessed portion 33 is formed as well as the rear wall portion 29 which is formed integrally with the slide portion 34 and serves as a spring seat.

The cam-slide supporting base 6 includes a base body 44 having a pair of side walls 41 and 42 and having the recessed portion 23 defined by the pair of side walls 41 and 42; the pair of cam-slide coming-off preventing plates 25 and 26 which are respectively secured to the pair of side walls 41 and 42 by means of screws 45 or the like; and a front wall 47 and the rear wall 48 which define a recessed portion 43 and is secured to the pair of side walls 41 and 42 by means of screws 46 or the like.

The cam slide 5 is slidable in the direction A as both lower surfaces 51 and 52 of the slide portion 34 are slidably brought into contact with upper surfaces 53 and 54 of the cam-slide coming-off preventing plates 25 and 26, and both upper surfaces 55 and 56 of the cam slide body 22 are slidably brought into contact with lower surfaces 57 and 58 of the cam-slide coming-off preventing plates 25 and 26.

The returning means 7 includes a coil spring 61 with one end seated on the front wall 47 and the other end seated on the rear wall 29; and a guide rod 62 which has one end threadedly secured to the front wall 47 and extends in such a manner as to be surrounded by the coil spring 61, so as to prevent the buckling of the coil spring 61. The coil spring 61 constantly urges the cam slide 5 toward the rear wall 48 by means of its resiliently expanding force.

At least one of the cam driver 3 and the cam slide 5, i.e., the cam slide 5 in this embodiment, is disposed with gaps 71 in a transverse direction (direction B) perpendicular to the direction A, which is the moving direction of the cam slide 5, with respect to the supporting base for supporting that at least one of them, i.e., with respect to the cam-slide supporting base 6 for supporting the cam slide 5 in this embodiment, in such a manner as to be supported movably in the direction B.

The gaps 71 include gaps 76 and 77 which are respectively located between both side surfaces 72 and 73 of the slide portion 34 and side surfaces 74 and 75 of the side walls 41 and 42, as well as gaps 82 and 83 which are respectively located between both side surfaces 78 and 79 of the constricted connecting portion 27 and both side surfaces 80 and 81 of the cam-slide coming-off preventing plates 25 and 26. The width of each gap 71 in the direction B may be, if possible, close to half of the width D of the sliding surface 2, but may preferably be determined on the basis of an estimated total of the aforementioned errors and an allowance of the offset.

The base body 44 is secured to an upper die base 93 of an upper die 92 by means of screws 91 or the like, and the upper die base 93 is attached to a hydraulic ram 95 by means of screws 94 or the like, and is capable of being raised or lowered. A guide post 97 and a slide plate 98 are attached to the lower die base 15 of a lower die 96, and the guide post 97 extends in such a manner as to be passed through a bush 100 fitted in a hole 99 in the upper die base 93, while the slide plate 98 is adapted to be slidably brought into contact with a side surface 101 of the upper die base 93. When the upper die base 93 is raised and lowered, the upper die base 93 is positioned with respect to the lower die base 15 while being guided by the guide post 97.

Figure 6:
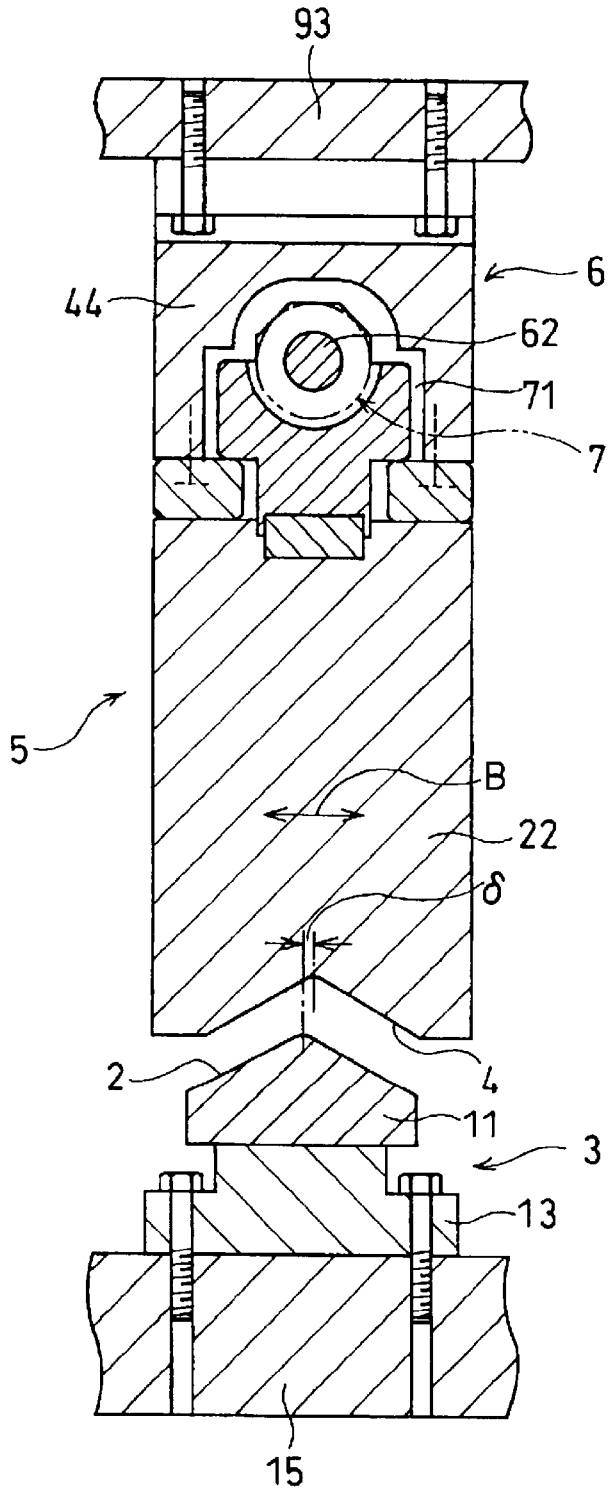
FIG. 6 is a diagram explaining the operation of the example shown in FIG. 1, and corresponds to FIG. 2.

In the above-described cam apparatus 1, when the upper die base 93 is raised by the hydraulic ram 95, as shown in FIGS. 5 and 6, the mutual contact of the sliding surfaces 2 and 4 is canceled, and the cam slide 5 is returned to its initial position by the returning means 7. When the upper die base 93 is lowered by the hydraulic ram 95, the sliding surface 4 is brought into contact with the sliding surface 2, whereby the cam slide 5 is moved forward while sliding on the sliding surface 2, so that the piercing punch 21 fitted to the cam slide 5 as shown in FIG. 1 is inserted into a through hole 112 in a button die 111 fitted in the lower die base 15, so as to effect predetermined punching. After punching, when the upper die base 93 is raised by the hydraulic ram 95, the cam slide 5 is retracted by the returning means 7 and is returned again to its initial position, as shown in FIGS. 5 and 6.

Figure 7:
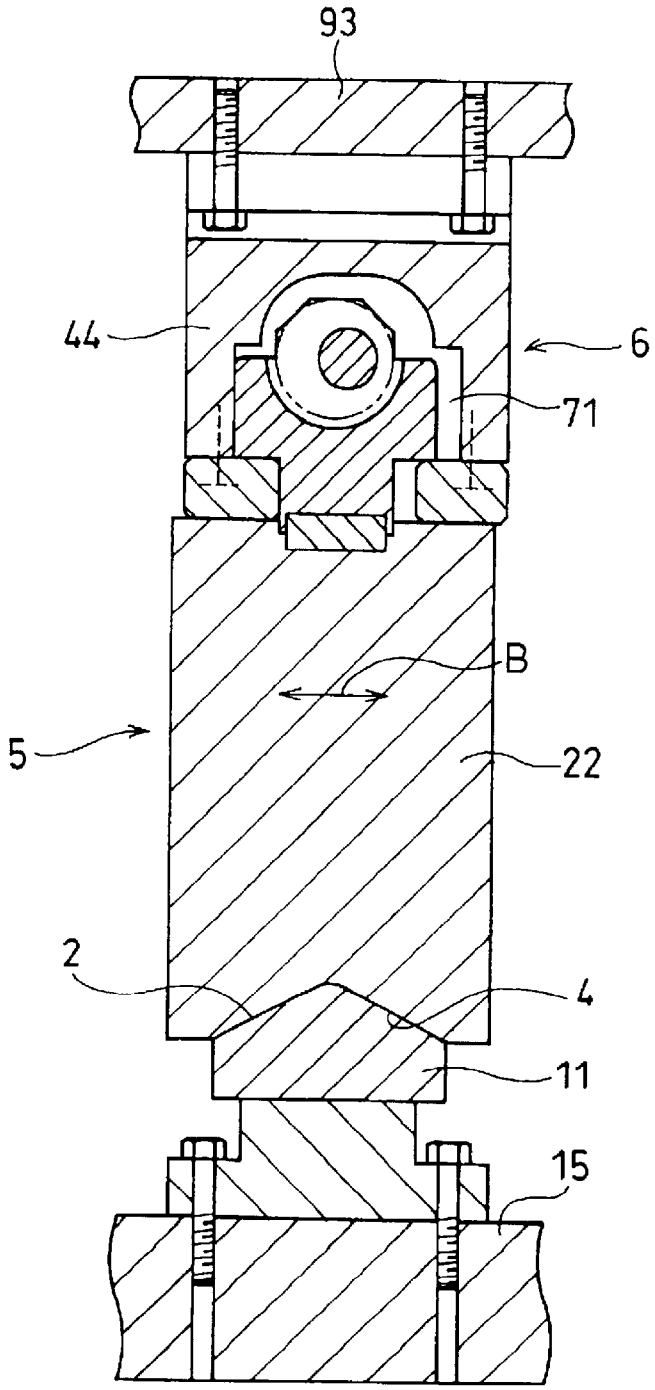
FIG. 7 is a diagram explaining the operation of the example shown in FIG. 1, and corresponds to FIG. 2.

With the cam apparatus 1, even if the sliding surface 4 is offset with respect to the sliding surface 2 by δ in the direction B as shown in FIG. 6 due to an error in attaching the cam-slide supporting base 6 to the upper die base 93, an error in attaching the cam slide 5 to the cam-slide supporting base 6, an error in the disposition of the upper die 92 and the lower die 96, and the like, this offset is corrected by the movement of the cam slide 5 in the direction B with respect to the cam-slide supporting base 6, as shown in FIG. 7, as the sliding surface 4 is brought into contact with the sliding surface 2. Hence, the cam slide 5 is moved forward while sliding on the sliding surface 2 without causing the sliding surface 4 to come into contact with the sliding surface 2 one-sidedly, so that the piercing punch 21 is inserted into the through hole 112 in the button die 111, as required, without riding over the button die 111.

Accordingly, with the cam apparatus 1, if the cam slide 5 is mounted on the cam driver 3 in a state in which the cam slide 5 is removed from the cam-slide supporting base 6 and the upper die 92 is not disposed, and if the positioning of the piercing punch 21 attached to the cam slide 5 and the button die 111 provided in the lower die 96, i.e., cutting edge adjustment, is effected, it becomes unnecessary to correct the result of this positioning after the attachment of the cam slide 5 to the cam-slide supporting base 6, or to shave off the sliding surface 4 or the sliding surface 2 to overcome the one-sided contact of the sliding surface 4 with the sliding surface 2.

Figure 8:
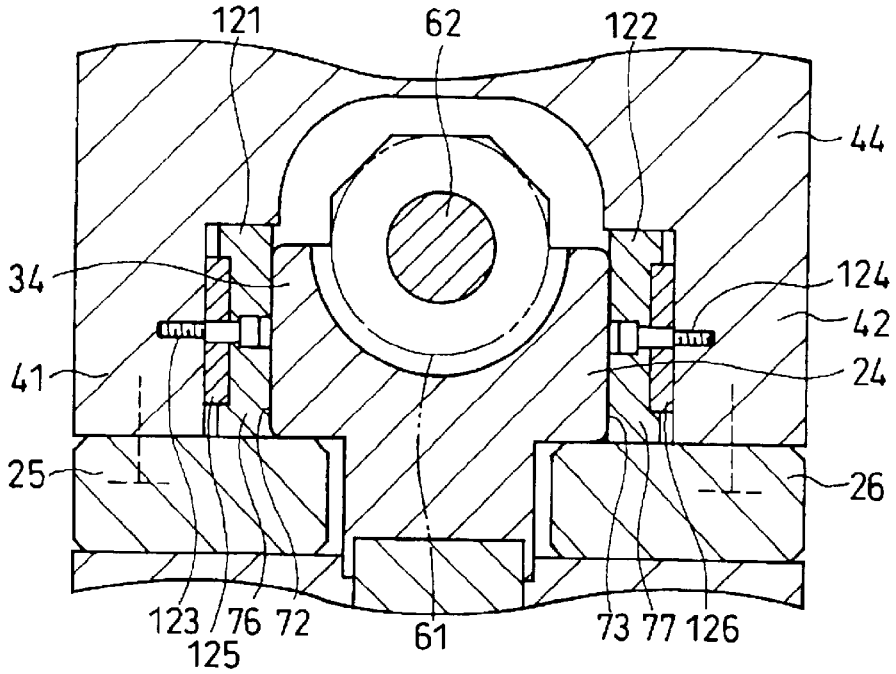
FIG. 8 is a partial front cross-sectional view of another preferred embodiment of the present invention.
Figure 9:
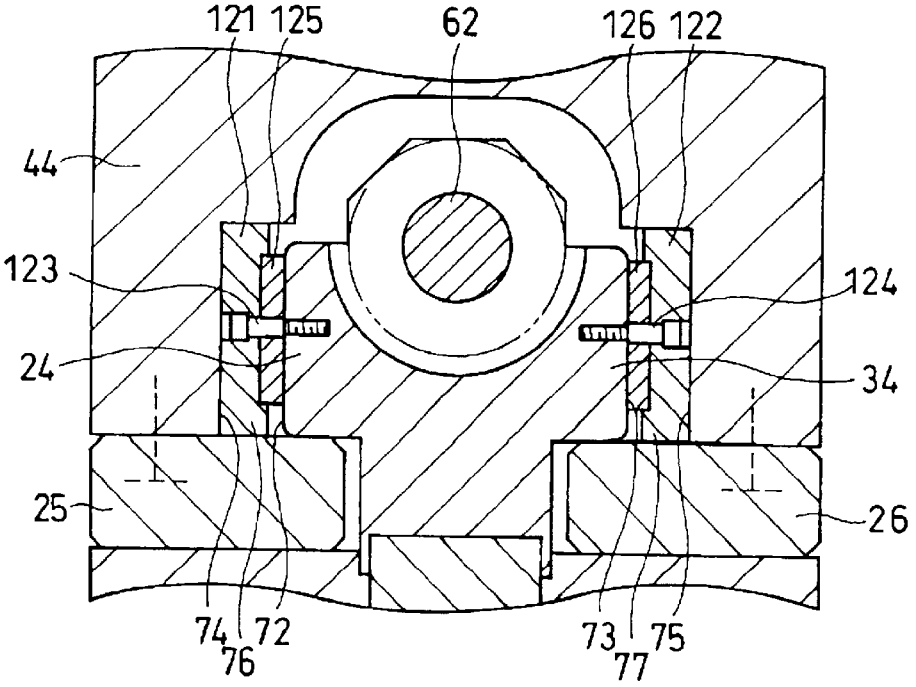
FIG. 9 is a partial front cross-sectional view of still another preferred embodiment of the present invention.

With the above-described cam apparatus 1, the cam slide 5 is made movable in the direction B with respect to the cam-slide supporting base 6 by providing the gaps 71 alone. However, as shown in FIGS. 8 and 9, resilient means 125 and 126 formed of leaf springs or urethane rubber plates may be respectively disposed in the gaps 76 and 77 among the gaps 71 in such a manner as to be covered with slide plates 121 and 122 and secured to the cam-slide supporting base 6 or the cam slide 5 together with the slide plates 121 and 122 by means of screws 123 and 124. In FIG. 8, the slide plates 121 and 122 which are respectively secured to the side walls 41 and 42 of the cam-slide supporting base 6 by means of the resilient means 125 and 126 are respectively pressed resiliently against the side surfaces 72 and 73 of the slide portion 34 and are slidable. In FIG. 9, the slide plates 121 and 122 which are respectively secured to side surfaces 72 and 73 of the slide portion 34 by means of the resilient means 125 and 126 are respectively pressed resiliently against the side surfaces 74 and 75 of the side walls 41 and 42 and are slidable.

It should be noted that the resilient means 125 and 126 may be disposed in the gaps 82 and 83 instead of or in addition to the gaps 76 and 77.

Figure 10:
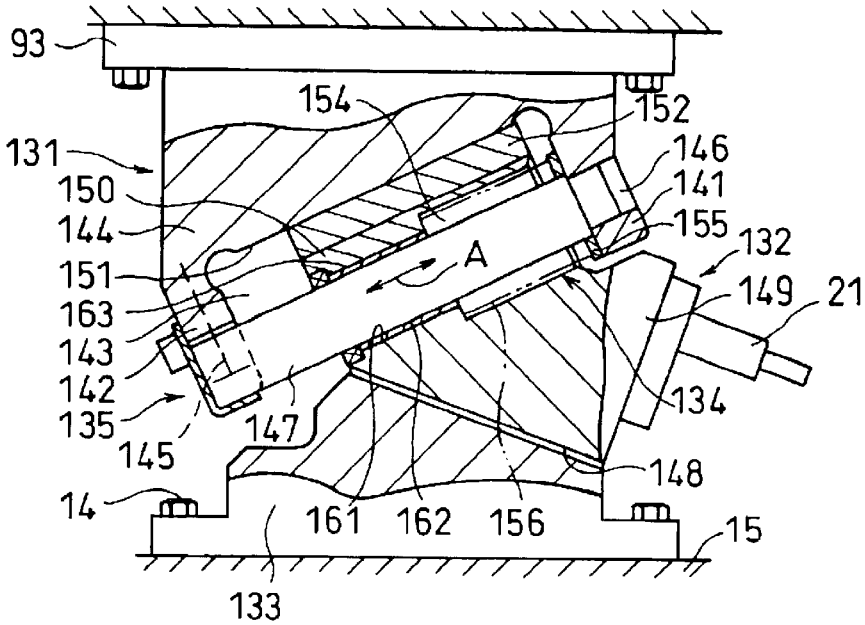
FIG. 10 is a cross-sectional view of a further preferred embodiment of the present invention.
Figure 11:
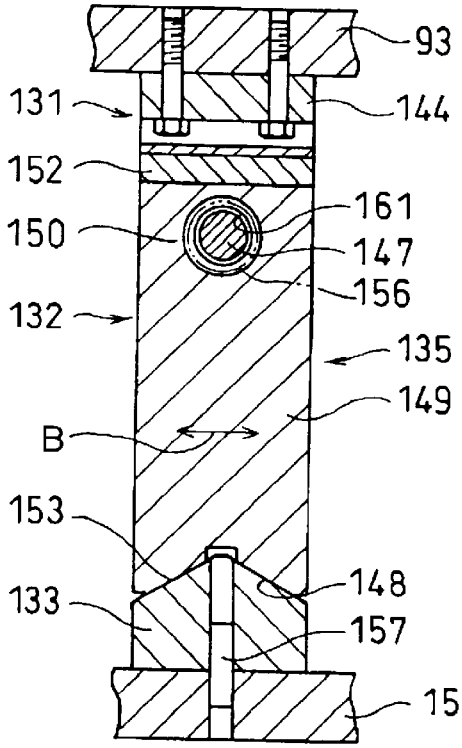
FIG. 11 is a cross-sectional view of the embodiment shown in FIG. 10, and corresponds to FIG. 2.

Furthermore, in the present invention, the cam apparatus may be a cam apparatus 135 which is comprised of a cam-slide supporting base 131, a cam slide 132, a cam driver 133, and a returning means 134, as shown in FIGS. 10 and 11. In FIGS. 10 and 11, the cam-slide supporting base 131 includes a base body 144 having a front wall 141 and a rear wall 142 and having a recessed portion 143 between the front wall 141 and the rear wall 142; and a cam-slide coming-off preventing rod 147 which is secured to the front wall 141 and the rear wall 142, defining the recessed portion 143 of the base body 144, by means of a screw 145 at one end thereof and by being inserted and secured in a hole 146, formed in the front wall 141, at the other end thereof. The cam slide 132 includes a cam slide body 149 to which the piercing punch 21 is adapted to be attached and on which a sliding surface 148 with a V-shaped cross section is formed; a slide member 150 which is disposed in the recessed portion 143 of the base body 144 and through which the cam-slide coming-off preventing rod 147 is passed; and a slide plate 152 which is secured to the slide member 150 and which is slidably brought into contact with a bottom surface 151 of the recessed portion 143. The cam driver 133 is formed by an integral member on an upper surface of which a sliding surface 153 with a V-shaped cross section with which the sliding surface 148 is slidably brought into contact is formed. The returning means 134 is constituted by a coil spring 156 disposed between one end of a hole 154 formed in the slide member 150 and a spring seat 155 disposed on the front wall 141. In this embodiment, the cam slide body 149 and the slide member 150 are formed integrally, and the cam-slide coming-off preventing rod 147 also functions to prevent the buckling of the coil spring 156. The cam driver 133 is secured to the lower die base 15 by a knock pin 157 as well, in addition to the screws 14.

In the cam apparatus 135, a bearing 163 fitted and fixed to the slide member 150 is disposed in a through hole 161 formed in the slide member 150, and an annular gap 162 is formed between an inner peripheral surface of the bearing 163 and an outer peripheral surface of the cam-slide coming-off preventing rod 147. Thus, in the cam apparatus 135, the cam slide 132 is supported by the cam-slide supporting base 131 in such a manner as to be movable in the direction B perpendicular to the direction A, which is the moving direction of the cam slide 132, by means of the gap 162.

It should be noted that, with the cam apparatus 135, the bearing 163 may be omitted, and the cam slide 132 may be supported by the cam-slide coming-off preventing rod 147 in such a manner as to be movable in the direction B via the gap 162 alone. Still alternatively, without forming the gap 162, the bearing 163 may be formed as an at least two-layered structure formed by a resilient layer and a sliding layer, and the cam slide 132 may be supported by the cam-slide coming-off preventing rod 147 in such a manner as to be movable in the direction B by means of the resilient extension and contraction of the resilient layer.

In accordance with the present invention, it is possible to make use of the advantage in cutting edge adjustment in the cam apparatus comprised of the cam driver having the sliding surface with the V-shaped cross section and the cam slide having the sliding surface with a shape complementary to that sliding surface. Moreover, even if attaching errors and a disposition error occur, it is possible to ensure desired surface contact of the mutual sliding surfaces of the cam driver and the cam slide and to overcome the drawbacks of one-sided contact and the like, and it is possible to eliminate the occurrence of burrs in actual processing and the possible incidence of breakage of the piercing punch as it rides over the button die.

What is claimed is:

1. A cam apparatus comprising:

a cam driver having a sliding surface with a V-shaped cross section and adapted to be fixedly supported by a cam-driver supporting base;

a cam slide having a sliding surface of a shape complementary to the sliding surface of said cam driver in such a manner as to be slidably brought into contact with the sliding surface of said cam driver; and a cam-slide supporting base for movably supporting said cam slide so that said cam slide can move while being guided by the sliding surface of said cam driver as the sliding surface of said cam slide and the sliding surface of said cam driver are brought into contact with each other, wherein at least one of said cam driver and said cam slide is supported by the supporting base of said at least one of them in such a manner as to be movable in a transverse direction perpendicular to a moving direction of said cam slide.

2. The cam apparatus according to claim 1, wherein said at least one of said cam driver and said cam slide is disposed with a gap with respect to the supporting base of said at least one of them in the transverse direction perpendicular to the moving direction of said cam slide.

3. The cam apparatus according to claim 2, wherein a resilient means is disposed in the gap.

4. The cam apparatus according to claim 3, wherein said resilient means is covered by a slide plate and is secured together with said slide plate to at least one of said cam driver and said cam slide or to the supporting base for supporting said at least one of them.

5. The cam apparatus according to claim 1, wherein said cam-slide supporting base includes a base body having a recessed portion and having a pair of side walls defining the recessed portion, and a pair of cam-slide coming-off preventing plates secured to the side walls of said base body, respectively, and said cam slide includes a cam slide body to which a tool is adapted to be attached and on which the sliding surface of the complementary shape is formed, a slide member disposed in the recessed portion of said base body, and a constricted connecting portion which connects said cam slide body and said slide member and is disposed between said cam-slide coming-off preventing plates.

6. The cam apparatus according to claim 1, wherein said cam-slide supporting base includes a base body having a recessed portion and having a front wall and a rear wall which define the recessed portion, and a cam-slide coming-off preventing rod secured to the front wall and the rear wall of said base body, and said cam slide includes a cam slide body to which a tool is adapted to be attached and on which the sliding surface of the complementary shape is formed, and a slide member which is disposed in the recessed portion of said base body and through which said cam-slide coming-off preventing rod is passed.

7. The cam apparatus according to claim 1, wherein said cam-slide supporting base is adapted to be attached to either one of a lower die base and an upper die base, and said cam-driver supporting base constitutes another one of said lower die base and said upper die base.

8. The cam apparatus according to claim 1, further comprising:

a returning means for returning said cam slide to its initial position when the sliding surface of said cam slide and the sliding surface of said cam driver are in noncontact with each other.

* * * * *